US006056149A

United States Patent [19]

Murphy et al.

[11] Patent Number: 6,056,149

[45] **Date of Patent: *May 2, 2000**

[54] BEVERAGE CONTAINER WITH SELF-CONTAINED DRINKING STRAW

[75] Inventors: Peter F. Murphy, Grosse Pointe, Mich.; Doug Brewer; Dave Brown, both of Chicago, Ill.; James H. Kurtz, Jr., Grosse Pointe Farms, Mich.; Jon Taylor; Paul Doczy, both of Chicago, Ill.

[73] Assignee: The PopStraw Company, LLC, Roseville, Mich.

[ * ] Notice: This patent is subject to a terminal disclaimer.

[21] Appl. No.: 08/856,837

[22] Filed: May 15, 1997

Related U.S. Application Data

[63] Continuation-in-part of application No. 08/699,546, Aug. 19, 1996, abandoned, which is a continuation of application No. 08/301,228, Sep. 6, 1994, Pat. No. 5,547,103.

[51] Int. Cl.[7] ..... A47G 21/18

[52] U.S. Cl. ..... 220/705; 215/389; 239/33

[58] Field of Search ..... 220/705, 706, 220/709, 710; 215/388, 389; 239/33

[56] References Cited

U.S. PATENT DOCUMENTS

| | | | |
|---|---|---|---|
| 1,309,994 | 7/1919 | McAuliffe | 220/706 |
| 3,263,855 | 8/1966 | Pugh, Sr. . | |
| 3,295,715 | 1/1967 | Pugh . | |
| 3,349,955 | 10/1967 | Cornelius . | |
| 3,547,308 | 12/1970 | Gillieon . | |
| 3,656,654 | 4/1972 | Brinkley, III . | |
| 3,717,476 | 2/1973 | Harvey . | |
| 3,746,197 | 7/1973 | Sather . | |
| 3,776,458 | 12/1973 | Chunga . | |
| 3,946,895 | 3/1976 | Pugh . | |
| 4,078,692 | 3/1978 | Stein . | |
| 4,109,817 | 8/1978 | Payne et al. . | |
| 4,226,356 | 10/1980 | Lemelson . | |
| 4,228,913 | 10/1980 | Mack et al. . | |
| 4,305,521 | 12/1981 | Komatsuta et al. . | |
| 4,356,927 | 11/1982 | Cooper et al. . | |
| 4,424,913 | 1/1984 | Ko . | |
| 4,462,503 | 7/1984 | DiRaffaele et al. . | |
| 4,537,324 | 8/1985 | Wang . | |
| 4,561,557 | 12/1985 | Park et al. . | |
| 4,582,213 | 4/1986 | Park et al. . | |
| 4,690,294 | 9/1987 | Jones . | |
| 4,709,829 | 12/1987 | Johnson et al. . | |
| 4,712,702 | 12/1987 | Ayabe et al. . | |
| 4,728,001 | 3/1988 | Serba . | |
| 4,826,034 | 5/1989 | Forbes . | |
| 4,842,157 | 6/1989 | Stone-Parker et al. . | |

(List continued on next page.)

FOREIGN PATENT DOCUMENTS

| | | |
|---|---|---|
| WO 85/04850 | 11/1985 | European Pat. Off. . |
| 2590237 | 11/1985 | France . |
| 2615487 | 11/1988 | France . |
| 2627753 | 9/1989 | France . |
| 2650488 A1 | 5/1978 | Germany . |
| 3-98877 | 4/1991 | Japan . |
| 4-44955 | 2/1992 | Japan . |
| 4-72149 | 3/1992 | Japan . |

*Primary Examiner*—Stephen Castellano
*Attorney, Agent, or Firm*—Harness, Dickey & Pierce, P.L.C.

[57] ABSTRACT

A beverage container has a straw-dispensing mechanism that is disposed within the container and is responsive to appropriate manipulation of the container to bring the straw into alignment with the orifice in the top end of the container. In one embodiment, the straw is supported by a weighted member that responds to the manipulation of the container to move the straw. A buoyant member is attached to the straw to elevate the straw through the orifice when the straw is aligned with the orifice. Several alternative embodiments of the invention incorporating the weighted member are disclosed. In another embodiment, the straw is supported by a buoyant member that responds to the manipulation of the container to move the straw. The buoyant member is attached to the straw to elevate the straw through the orifice when the straw is aligned with the orifice as well as to align the straw with the orifice due to the manipulation of the can.

21 Claims, 10 Drawing Sheets

U.S. PATENT DOCUMENTS

| | | | |
|---|---|---|---|
| 4,877,148 | 10/1989 | Larson et al. . | |
| 4,892,187 | 1/1990 | Stein . | |
| 4,923,083 | 5/1990 | Forbes . | |
| 4,923,084 | 5/1990 | Forbes . | |
| 4,925,040 | 5/1990 | Wang . | |
| 4,930,652 | 6/1990 | Murphy et al. . | |
| 4,948,008 | 8/1990 | Wu et al. . | |
| 5,054,639 | 10/1991 | Ahn . | |
| 5,080,247 | 1/1992 | Murphy et al. | 215/389 |
| 5,160,058 | 11/1992 | Ahn . | |
| 5,172,827 | 12/1992 | Chang et al. . | |
| 5,244,112 | 9/1993 | Murphy et al. | 215/389 |
| 5,253,779 | 10/1993 | Lee . | |
| 5,431,297 | 7/1995 | Rosello | 220/706 |
| 5,547,103 | 8/1996 | Murphy et al. | 220/709 |
| 5,586,681 | 12/1996 | Policappelli | 220/710 |
| 5,819,979 | 10/1998 | Murphy et al. | 215/388 |

BEVERAGE CONTAINER WITH SELF-CONTAINED DRINKING STRAW

CROSS REFERENCE TO RELATED APPLICATIONS

This application is a continuation-in-part of U.S. application Ser. No. 08/699,546, filed Aug. 19, 1996, now abandoned, which is a continuation of U.S. application Ser. No. 08/301,228, filed Sep. 6, 1994, now U.S. Pat. No. 5,547,103.

BACKGROUND AND SUMMARY OF THE INVENTION

The present invention relates to beverage containers and, in particular, to a beverage container having a self-contained straw. Currently, beverage containers are manufactured, fitted, and sealed in a high-speed automated process. This process includes manufacturing a separate body for containing the fluid or beverage and a separate lid for sealing the open end of the body. During manufacture of the beverage container, a manufacturing operation known as "seaming" places the lid on a filled can body and seals its perimeter. At present, known seaming operations pass the lids horizontally across the top of the beverage containers at a vertical distance of only a few millimeters above the top edge of the beverage container. The seaming operation involves the use of very expensive high-speed machinery and tooling.

Various designs have been proposed in the patent art for placing a straw within a beverage can that becomes accessible to the user when the tab in the lid of the can is deflected into the interior to open the can. The vast majority of these designs can be categorized into two groups. The first group comprises designs wherein the straw is installed within the can so as to be prealigned with the tab opening. Thus, when the tab is opened, access to the straw is presented. The practical disadvantage with this approach is that the bodies and lids of the cans are randomly oriented during the seaming operation. Consequently, any design that requires prealignment of the straw with the opening in the lid is not readily adaptable to existing canning equipment.

The second group of designs generally involves the mounting or attachment in some manner of the straw to the underside of the lid such that when the can is opened, the end of the straw is drawn through or otherwise made accessible through the opening. These designs are also not readily adaptable to existing canning equipment due to the fact, as noted above, that commercial canning processes pass the lid within a few millimeters of the top of the can during the high-speed seaming operation. Consequently, any structure that is attached or otherwise appended to the underside of the lid will disrupt the seaming process.

A third approach disclosed in U.S. Pat. Nos. 5,244,112; 5,080,247; and 4,930,652 which are assigned to the assignee of the present invention, describe various embodiments of a straw-dispensing mechanism that is disposed within the body of the container and operates to rotate the straw into alignment beneath the orifice of an opened beverage container. In particular, the designs described in these patents respond to the deflection of the closure tab into the body of the container to actuate or drive the rotating mechanism. While these designs remain technologically and commercially viable, other means, and in particular other forces, are available to align the straw with the orifice of an opened beverage container.

In this regard, the present invention proposes a beverage container containing a straw-dispensing mechanism that relies upon user manipulation of the container and the forces of gravity and buoyancy to bring the straw into alignment with the opening in the lid. In particular, with the beverage container according to the present invention, the user merely tilts the container, preferably prior to opening, to cause the mechanism within the container to bring the straw substantially into alignment with the tab. Once the container is opened, further minor manipulation of the container may be necessary to complete the alignment of the straw with the orifice.

Several embodiments of the present invention are disclosed. A first embodiment employs a swing arm that is rotatably mounted at one end to a central post located on a base member mounted at the bottom of the container. The straw is supported vertically at the outer radial end of the swing arm. Preferably, the swing arm is weighted so that when the container is tilted, the arm freely rotates in the direction the container is tilted, to bring the straw into alignment with the orifice. If the container is manipulated before it is opened, the container is preferably tilted toward the user with the tab in the 8 o'clock position. This serves to position the straw in a slightly misaligned position with respect to the tab in the lid. In this manner, the tab will not strike the straw when deflected into the interior of the container. After the container is opened, a final slight manipulation of the container serves to align the straw with the orifice in the lid. Preferably, a float is attached to the straw to elevate the straw through the orifice.

In a second embodiment, a substantially vertically oriented guide post is pivotally mounted at its lower end via a ball and socket joint to the center of a base member that is mounted at the bottom of the container. A straw is slidably positioned onto the guide post. A weighted positioning disk is attached to the straw adjacent its upper end so that when the container is tilted, gravitational forces acting on the disk cause the straw to tilt in a corresponding direction. The diameter of the weighted disk is sufficient to properly position the straw radially beneath the tab when the disk contacts the sidewall of the container. As before, a float secured to the straw serves to elevate the straw through the orifice in the lid.

A third embodiment is disclosed which is similar to the second embodiment except that the base member has been eliminated so that the straw assembly is freely disposed within the container. A weighted positioning disk is attached near the upper end of the straw and a float is secured adjacent the bottom end of the straw. Thus, the buoyant characteristics of the float cause the bottom of the straw to contact the lower side of the container at a first point and the weighted disk contacts the upper side of the container at a substantially radially opposite point. Tilting of the container thus causes the weighted disk to move along the interior wall of the container, enabling the user to manipulate the container to bring the straw into alignment with the orifice in a manner similar to that described above. As before, the diameter of the weighted disk is such that the straw is radially offset by the disk from the sidewall of the container by the same distance as the lid orifice.

As will be appreciated by those skilled in the art, the latter two embodiments of the present invention in particular are readily adaptable for use in other types of beverage containers having offset orifices, such as gable-top containers and rectangular or square beverage cartons commonly referred to as "aseptic" cartons in the trade.

A sixth embodiment is disclosed which is similar to the second embodiment described above. The sixth embodiment includes a substantially vertically oriented guide post which is pivotally mounted at its lower end via a ball and socket joint to the center of a base member that is mounted at the bottom of the container. A straw is slidably positioned with respect to the guide post. A weighted positioning disk is attached to the guide post adjacent its upper end so that when the container is tilted, gravitational forces acting on the weighted positioning disk cause the guide post and thus the straw to tilt in a corresponding direction. The diameter of the weighted disk is sufficient to properly position the straw radially beneath the tab when the weighted positioning disk contacts the sidewall of the container. As before, a float secured to the straw serves to elevate the straw through the orifice in the lid. This embodiment includes the advantage over the second embodiment that the float only has to lift the straw and not the weighted positioning disk.

A seventh embodiment of the present invention is similar to the second embodiment except that this embodiment relies on buoyancy to both position and lift the straw. The seventh embodiment includes a substantially vertically oriented guide post which is pivotally mounted at its lower end via a ball and socket joint to the center of a base member that is mounted at the bottom of the container. A straw is slidably positioned with respect to the guide post. A float is attached to the straw adjacent its upper end so that when the container is tilted, the buoyancy of the float will cause the straw to remain essentially vertical. The diameter of the float is sufficient to properly position the straw radially beneath the tab when the float contacts the sidewall of the container. The float also serves to elevate the straw through the orifice in the lid. This embodiment thus requires the tilting of the container in a direction opposite to the direction of the previous embodiments. This direction of tilting offers the advantage that with an open container, the tilting of the container will have less tendency to spill the liquid within the container when manipulating the container.

An eighth embodiment of the present invention is similar to the seventh embodiment except that this embodiment includes a contoured lid which includes a ramped section to guide the straw to the orifice in the lid.

Thus, it is an object of the present invention to provide a beverage container with a self-contained straw-dispensing mechanism that is compatible for manufacture with existing canning equipment.

In addition, it is an object of the present invention to provide such a beverage container with a self-contained straw-dispensing mechanism that is simple in design, utilizes a minimum of material, is inexpensive to manufacture, and requires relatively inexpensive equipment to assemble and insert into the containers.

In addition, it is an object of the present invention to provide a simple and inexpensive straw-dispensing mechanism that is readily adaptable for use in a wide variety of beverage containers having offset orifices, such as beverage cans, gable-top containers, and square or rectangular cartons.

Additional objects and advantages of the present invention will become apparent from a reading of the following detailed description of the preferred embodiments which makes reference to the drawings of which:

DETAILED DESCRIPTION OF THE PREFERRED EMBODIMENT

Figure 1:
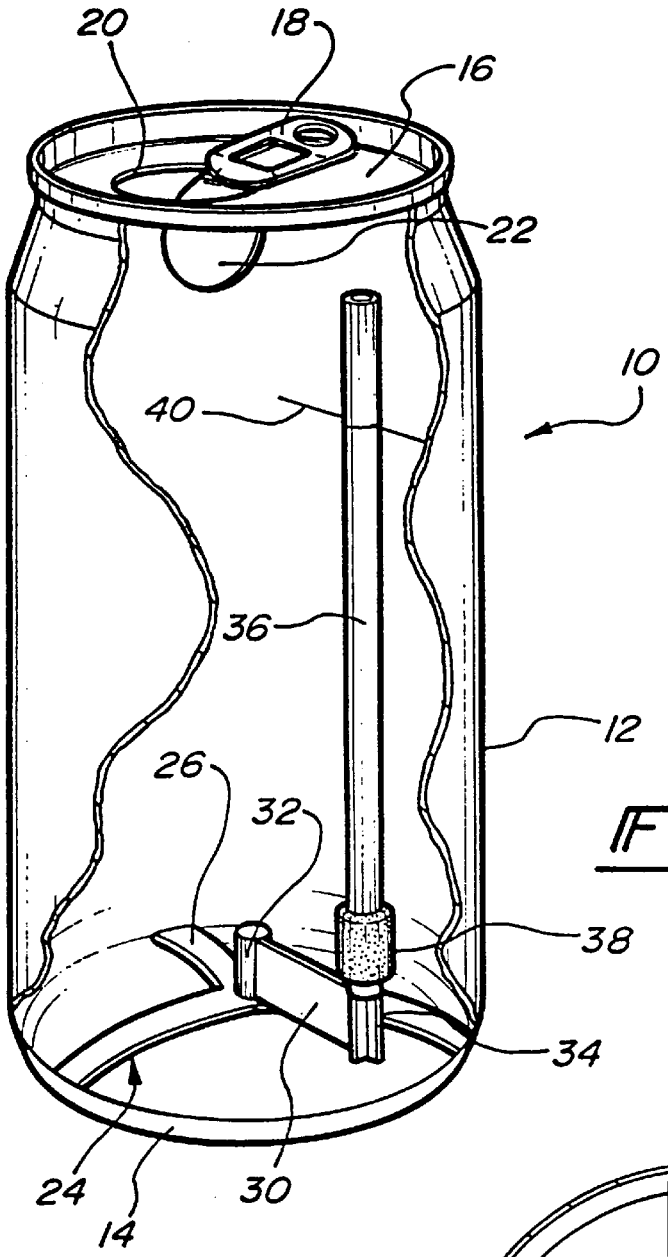
FIG. 1 is a partial cutaway view of a beverage can containing a straw-dispensing mechanism in accordance with a first embodiment of the present invention.

Referring to FIG. 1, a first preferred embodiment of a beverage can according to the present invention is shown. The beverage can 10 comprises a conventional aluminum, steel or plastic container having a cylindrical body 12 with a closed bottom 14 and a lid 16 that is joined by a seaming operation to the body 12 of the can. The lid includes an actuating member lever ring 18 pivotally secured to the lid 16 that is adapted when actuated to open an orifice 20 in the lid by deflecting a closure tab 22 into the interior of the can.

The closure tab 22 is formed by score lines in the lid 16 which enable a controlled portion of the closure tab 22 to break free from the lid 16 when the lever ring 18 is actuated against the tab by the user. As the user lifts the ring 18 to its maximum extent, the closure tab 22 is typically designed via the score lines to deflect downwardly and toward one side of the orifice 20 to fully open the orifice and facilitate the free flow of liquid through the orifice.

The straw-dispensing mechanism according to the present invention includes a base member 24 having either two or three radially extending legs 26. The base member 24 is preferably made from a lightweight plastic material with the legs 26 being flexible and adapted to be compression-fit to the bottom 14 and/or sidewalls of the can body 12. Attentively, the base member 24 may be adhered to the bottom 14 of the can by other means.

Projecting vertically upward from the central portion of the base 24 is a post 28 about which a swing arm 30 is rotatably connected. In particular, the swing arm 30 includes a collar portion 32 at one end that is adapted to fit onto the post 28 with sufficient clearance to enable the swing arm 30 to freely rotate about the post 28. Preferably, the collar portion 32 of the swing arm 30 and the post 28 are designed so that the collar portion 32 snaps onto the post 28 to prevent inadvertent separation of the two components. The outer radial end of the swing arm 30 has integrally formed thereon a vertically extending locating post 34 which is adapted to receive a straw 36. The radial length of the swing arm 30 from the collar portion 32 to the straw locating post 34 is such that when the swing arm 30 is rotated to a position in line with the orifice 20 in the lid of the can, the locating post 34 will be directly beneath the orifice 20.

A drinking straw 36 having a float member 38, preferably cellular foam, attached near its bottom end, is adapted to freely slide onto the locating post 34. The float 38 is designed to provide sufficient buoyant force (when liquid is present in the can) to cause the straw 36 to ascend through the orifice 20 in the can lid 16 when the straw is aligned with the orifice 20. It will be noted that the height of the locating post 34 is substantially greater than the vertical distance between the top of the straw 36 and the underside of the lid 16 to ensure that the straw ascends in a straight path up through the orifice 20. As best shown in FIG. 1, the locating post 34 is preferably formed with a cross-shaped cross-section to minimize the frictional interface between the locating post 34 and the straw 36 when the straw ascends through the orifice 20.

To align the straw 36 with the orifice 20 in the lid 16, the user momentarily tilts the can toward himself with the closure tab 22 aligned in approximately the 8 o'clock position, or angularly offset slightly from the user (the 6 o'clock position defining the direction toward the user). The tilting of the can toward the user causes the swing arm 30 to rotate under the force of gravity to the 6 o'clock position so that the straw 36 is slightly misaligned with the orifice 20. With the can preferably reoriented to its normal vertical position, the user then lifts the lever ring 18 to deflect the closure tab 22 into the interior of the can. With the orifice now opened, a further slight manipulation or tilting of the can in the direction of the orifice 20 serves to bring the straw 36 into alignment and thereby permit the straw to ascend through the orifice 20.

Note, when the can is initially tilted toward the user, it is preferred that the closure tab 22 be oriented in the 8 o'clock position rather than the 4 o'clock position. This is due to the fact that conventional beverage cans typically have closure tabs 22 that are designed to deflect downwardly and toward the left side of the orifice 20 (i.e., left-hinged closure tabs). Consequently, when the can is subsequently opened by the lifting of the lever ring 18, the closure tab 22 does not strike the straw 36 as it is deflected into the interior of the can, nor does it obstruct the final movement of the straw 36 to bring it into alignment with the orifice 20. Obviously, for beverage cans with right-hinged closure tabs, an initial 4 o'clock position would be preferred.

Optionally, of course, the user may elect to open the can first before the can is manipulated to bring the straw into alignment with the orifice. When this procedure is followed, the user tilts the opened can in the direction of the orifice 20 as though intending to dispense liquid from the can. The resulting rotation of the swing arm 30 will thus bring the straw 36 directly into alignment with the orifice 20. Obviously, when following this procedure, the user must be careful to avoid tilting the can too much so that liquid is not inadvertently dispensed from the can. However, this procedure can readily be accomplished without spillage given the typical level of liquid in a filled can.

In addition, the user may manipulate the can in other ways to cause the straw 36 to move into alignment with the orifice 20. For example, the user may impart a circular motion to the can to initiate a circular movement of the liquid within the can. Alternatively, the user may combine both circular and tilting motions and impart a slow "wobble" to the can to facilitate the desired rotational movement of the straw.

In order to facilitate the movement of the swing arm 30 in response to the relatively slight tilting of the case, the swing arm 30 is preferably weighted or localized weight is added to the outer radial end of the swing arm 30. The added weight enables the swing arm 30 to more quickly respond to the user manipulation of the can. The additional weight may also serve to enable the user to achieve the desired alignment with a smaller angle of tilt, thus facilitating proper manipulation of the can without spillage.

In addition, the central post 28 may be lengthened so that the swing arm 30 rotates about a horizontal plane that is closer to the middle of the can from a height standpoint. In such an embodiment an annular guide sleeve would be substituted for the straw locating post 34 at the outer radial end of the swing arm 30 to support the straw. With this alternative embodiment, the straw-manipulating mechanism will respond to smaller tilt angles, thus facilitating attainment of the desired alignment with less risk of spillage.

To prevent the float 38 from elevating the straw 36 during the can filling and seaming processes, and thus possibly interfering with these processes, a small amount of soluble adhesive, such as glucose or thixotropic gel, is preferably applied to temporarily bond the straw 36 to the locating post 34 and/or the swing arm 30. Accordingly, after the seaming operation is completed, the adhesive will gradually dissolve and thereby enable the straw 36 to float freely upward until it contacts the underside of the lid 16.

Alternatively, the straw-locating post 34 may be thermally expanded prior to placement of the straw 36 onto the post 34. The resulting slight thermal expansion of the post 34 creates a friction fit between the straw 36 and the post. After the filling and seaming processes are completed, the subsequent lowering of the temperature of the locating post 34 causes it to contract and thereby release its frictional engagement with the straw 36. Either of these alternative means for temporarily securing the vertical position of the straw 36 can, of course, be used with a swing arm 30 having a guide sleeve for supporting the straw instead of a support post 34.

In addition, it may be desirable to provide a stop member 40, which may comprise a simple annular ring having a pair of flexible arms, that is secured to the straw 36 near its upper end to limit the extent to which the straw is elevated by the float 38 through the orifice 20, but which may be readily overcome by the user simply by grasping the top of the straw and pulling the stop 40 through the orifice 20. The stop 40 would thus serve to ensure that the straw 36 does not inadvertently choke a user that opens the can and begins ingesting the liquid directly from the can in a conventional manner.

In this embodiment, as well as the other embodiments described herein, the straw 36 is preferably convoluted along most of its length so that it can be extended by the user to reach fully to the bottom of the can.

Figure 2:
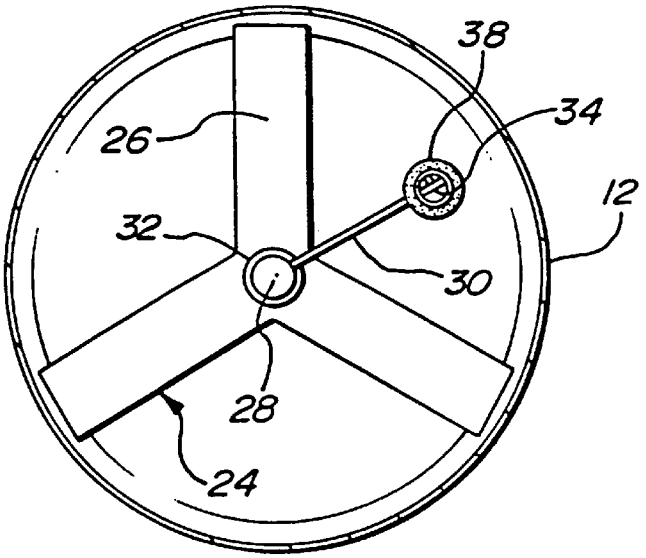
FIG. 2 is a horizontal sectional view of the beverage can shown in FIG. 1.
Figure 3:
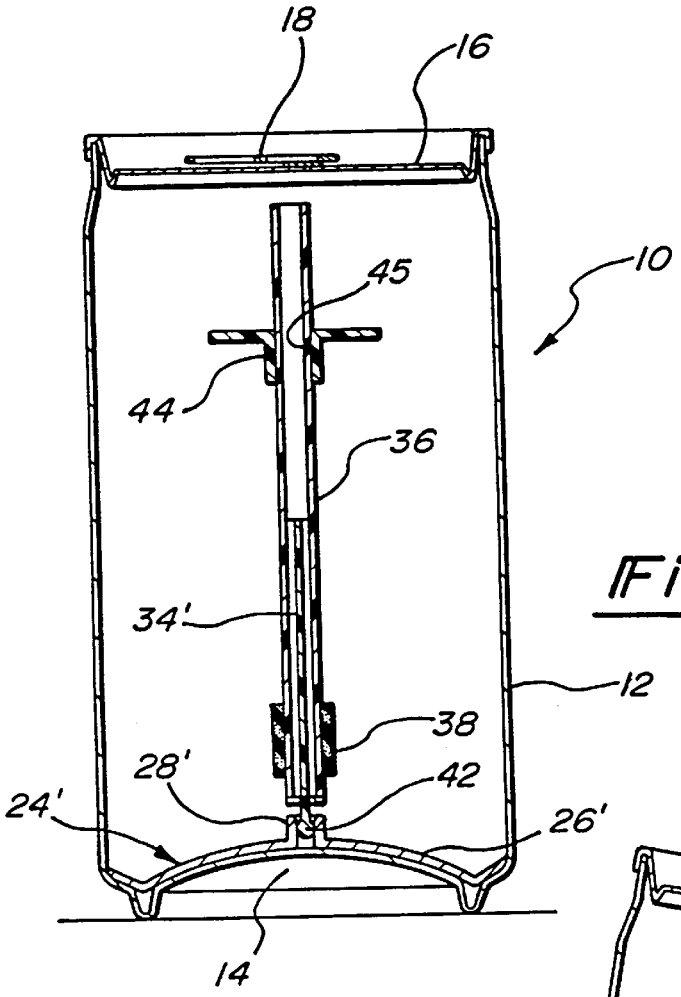
FIG. 3 is a vertical sectional view of a beverage can containing a straw-dispensing mechanism according to a second embodiment of the present invention.
Figure 4:
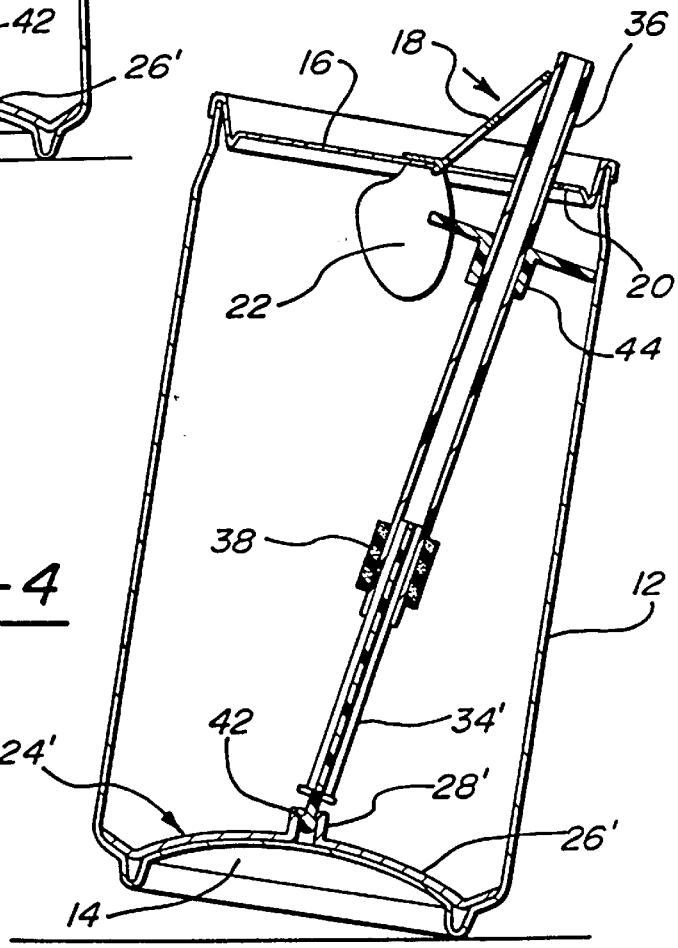
FIG. 4 is an equivalent sectional view of the beverage can shown in FIG. 3 illustrating the position of the straw when the can is slightly tilted.
Figure 5:
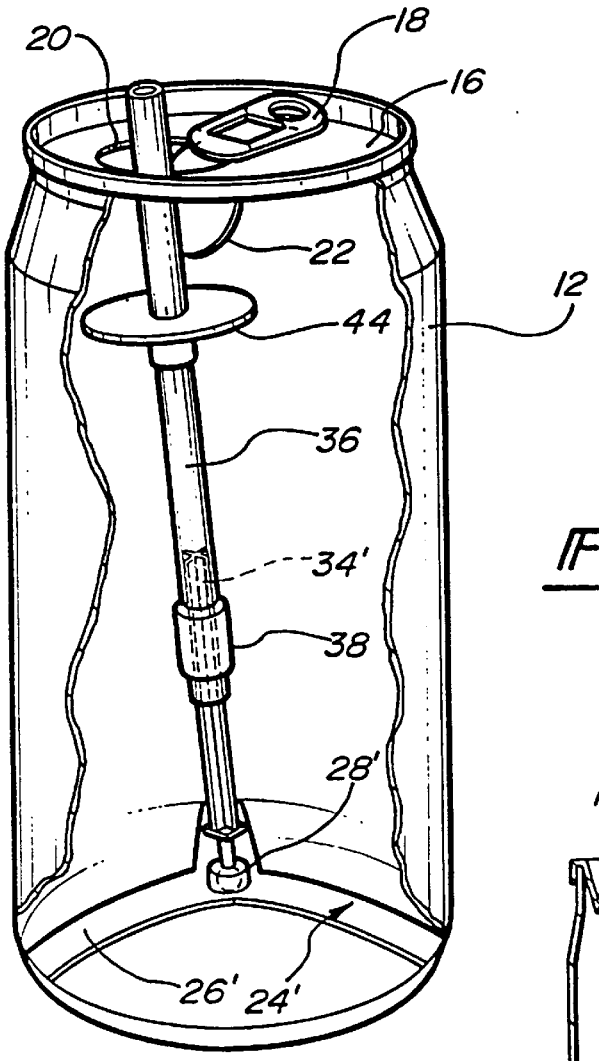
FIG. 5 is a partial cutaway view of the beverage can shown in FIGS. 3 and 4 illustrating the straw ascending through the orifice in the lid of the can.

Referring to FIGS. 3–5, an alternative embodiment of the present invention is shown. Equivalent components to those shown in the previous embodiment are labeled with a "'". The straw-manipulating mechanism in this embodiment also includes a base member 24' similar to the base member 24 shown in FIGS. 1 and 2 with either two or three legs 26' adapted to engage the bottom 14 of the can body 12. Located at the center of the base member 24' is a socket 28' that is adapted to receive an appropriately sized ball 42 that is formed at the bottom of the straw support post 34'. The ball end 42 of the support post 34' is thus adapted to be snapped into the socket 28' in the base 24' so that the support post 34' can freely pivot and rotate about the base socket 28'. The straw 36 is adapted to be slid onto the support post 34' and temporarily retained thereon as described above.

Attached to the upper portion of the straw 36 is a positioning disk 44 having a central aperture or bore 45 formed therein for frictionally receiving the straw 36. Once attached to the straw, the positioning disk 44 has associated therewith sufficient weight to cause the upper end of the straw to fall toward the sidewall of the can body 12 when the can is tilted, as shown in FIG. 4. The diameter of the positioning disk 44 is sized so that when the disk contacts the sidewall of the can, the straw 36 is offset therefrom by an amount equal to the radial offset of the orifice 20 in the lid 16. This ensures proper radial alignment between the straw 36 and the orifice 20 when the straw and the orifice are angularly aligned.

Thus, to align the straw 36 with the orifice 20 in the lid 16, the user follows either of the procedures outlined above. In this embodiment, when the can is tilted, the gravitational force exerted on the positioning disk 44 causes the disk, together with the straw, to rotate freely along the sidewall of the can body 12 about the ball and socket joint until the low point is reached (i.e., the direction of the tilt). When the straw is aligned with the orifice, the buoyancy of the float 38, which is sufficient to overcome the weight of the positioning disk 44, causes the top of the straw to ascend through the orifice 20 until the positioning disk 44 contacts the underside of the lid 16. In the preferred embodiment, the straw will initially ascend approximately 1–2 inches above the lid of the can.

At this point the user may elect to commence drinking through the straw, or withdraw the straw further from the can. In this embodiment, the positioning disk 44 may be formed with sufficient rigidity and the frictional interface between the straw 36 and the positioning disk may be sufficiently low to permit the straw to be pulled upwardly through the positioning disk as the positioning disk is held against the underside of the lid 16. As presently noted, the straw 36 is preferably convoluted along most of its length so that it can thereafter be extended by the user to reach fully to the bottom of the can.

Alternatively, the positioning disk 44 may be sized and designed with sufficient flexibility to enable the user to extract the positioning disk through the orifice 20 as the straw 36 is pulled out of the can. Once pulled through the orifice and while still positioned on the straw, the positioning disk 44 may optionally be configured to compressively fit into the orifice. The user may thereupon elect to position the disk 44 into the orifice 20 so that it is retained under slight compression along the edges of the orifice. Once positioned in this manner, the positioning disk 44 serves to stabilize the straw 36 during use and also substantially encloses the orifice 20 to prevent contaminants as well as insects from entering the can.

Figure 6:
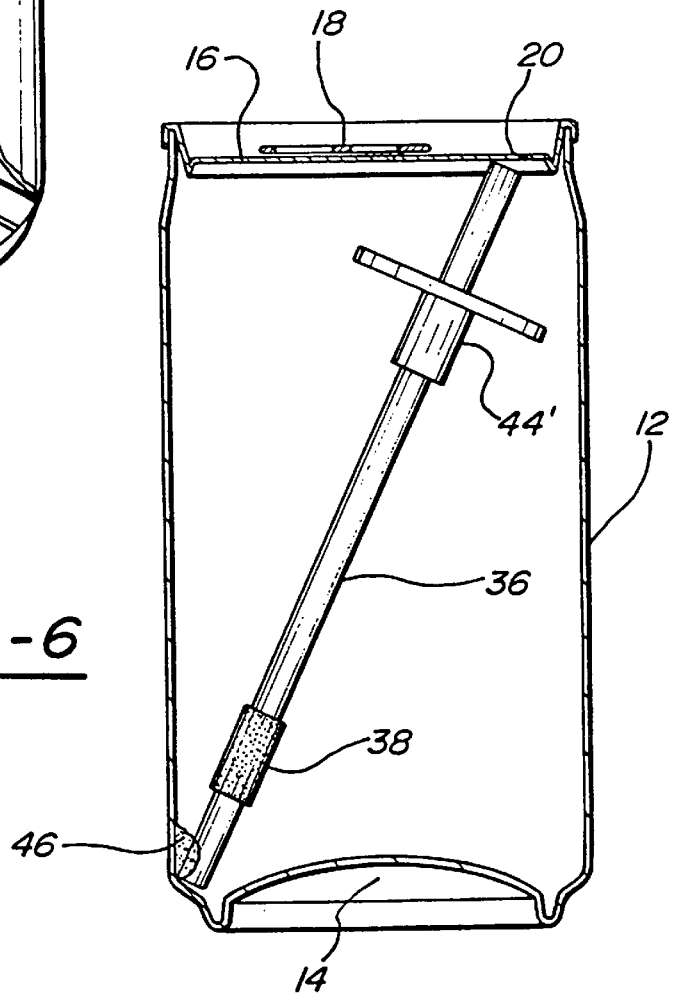
FIG. 6 is a vertical sectional view of a beverage can containing a straw-dispensing mechanism according to a third embodiment of the present invention.
Figure 7:
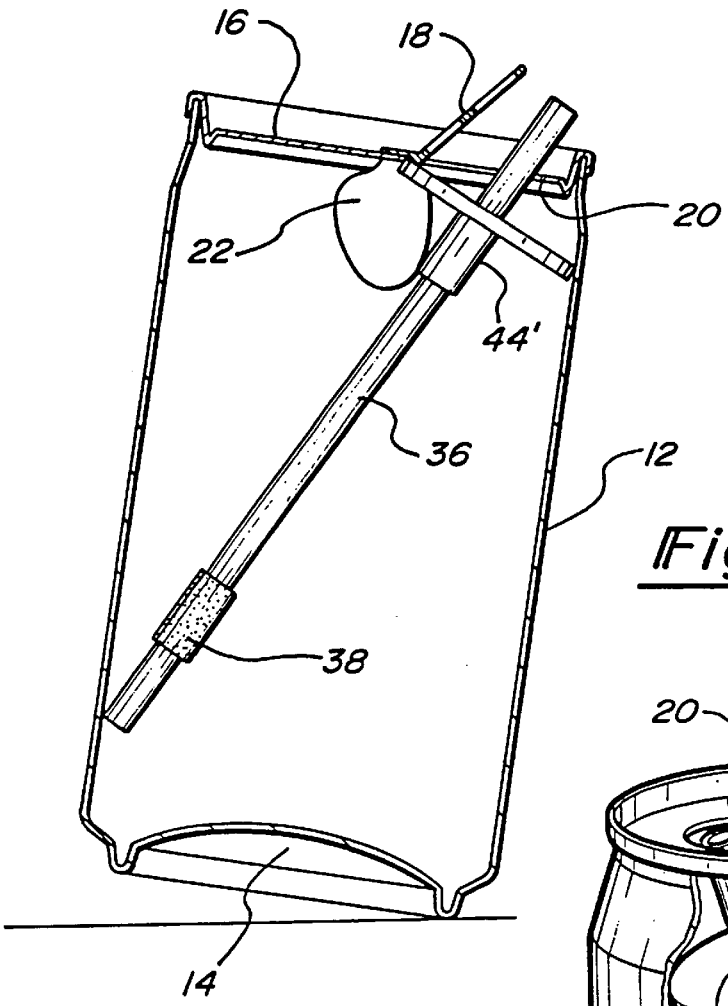
FIG. 7 is an equivalent sectional view of the beverage can as shown in FIG. 6 illustrating the position of the straw when the can is slightly tilted.
Figure 8:
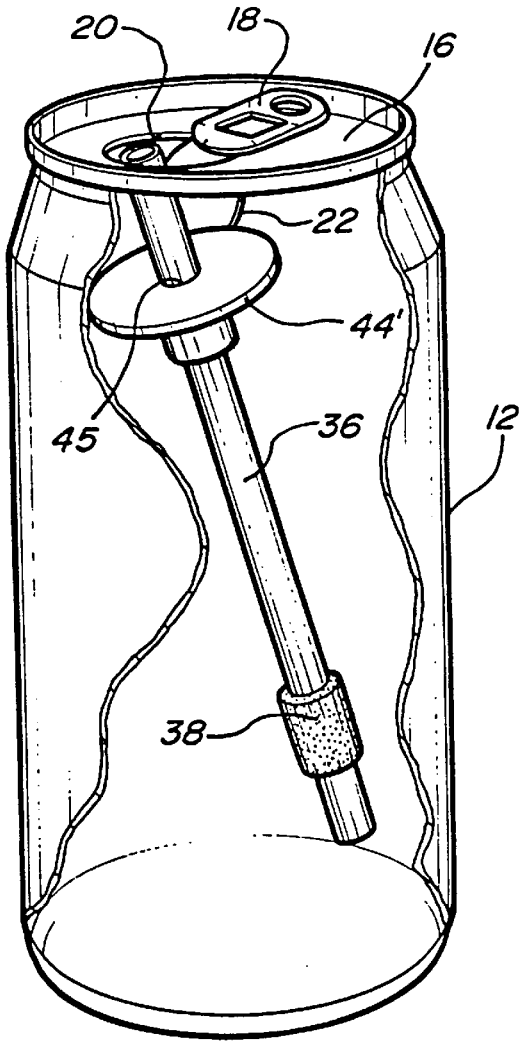
FIG. 8 is a partial cutaway view of the beverage can as shown in FIGS. 6 and 7 illustrating the straw ascending through the orifice in the lid of the can.

Turning now to FIGS. 6–8, a third preferred embodiment of the present invention is shown. In this embodiment the straw 36 has a float 38 attached near its lower end and a weighted positioning disk 44' attached near its upper end. When initially disposed in the can prior to the filling and seaming processes, the lower end of the straw 36 is preferably adhered temporarily adjacent to the bottom 14 of the can with a small amount of soluble adhesive 46, as described in the initial embodiment. Subsequently, after the filling and seaming processes are completed, the adhesive bond 46 will dissolve, enabling the straw 36 to float freely within the can. Due to the positioning of the float 38 beneath the disk 44' on the straw, the orientation of the straw 36 within the can will remain substantially as shown in FIG. 8 with the bottom end of the straw 36 contacting the sidewall of the can body 12 at a first point and the positioning disk 44' contacting the sidewall of the can at a second substantially radially opposite point. As in the previous embodiment illustrated in FIGS. 3–5, the diameter of the position disk 44' is selected so that the top of the straw is radially offset from the sidewall of the can by a distance corresponding to the radially offset position of the orifice 20 in the lid 16. In this manner, when the user manipulates the can to cause the disk 44' to move along the inside wall of the can, the straw 36 will rotate into alignment with the orifice 20. The buoyancy of the float 38 is sufficient to overcome the weight of the positioning disk 44' so that when brought into alignment with the orifice 20 the straw 36 will ascend through the orifice 20.

To bring the straw 36 into alignment with the orifice 20 in the lid, the user follows either of the same two procedures outlined above. As in the previous embodiment, once aligned with the orifice 20, the straw will elevate through the orifice until the positioning disk 44' contacts the underside of the lid 16. Thereupon, the options presented to the user are the same as those described in connection with the embodiment illustrated in FIGS. 3–5.

Figure 8A:
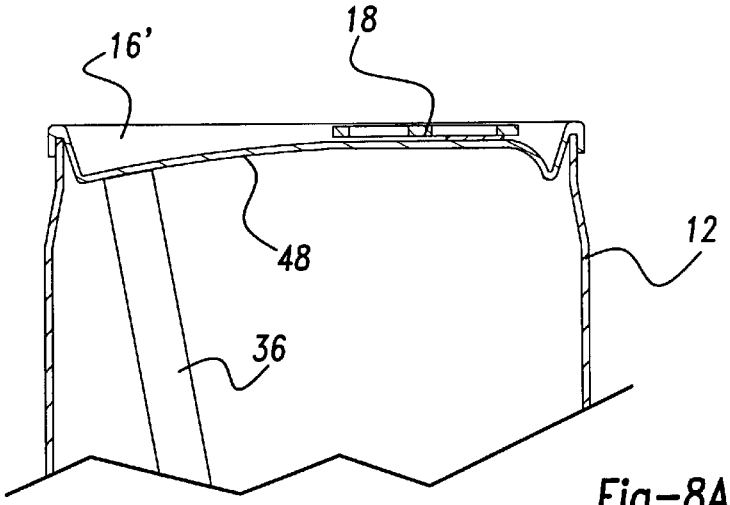
FIG. 8A is a partial cutaway view of the beverage can shown in FIGS. 6–8 illustrating an alternative lid design.

FIG. 8A illustrates a modification to the embodiment shown in FIGS. 6–8. Lid 16 of the previous embodiment is replaced by a lid 16' which includes a contoured surface 48 which guides straw 36 to orifice 20 in lid 16'.

Figure 9:
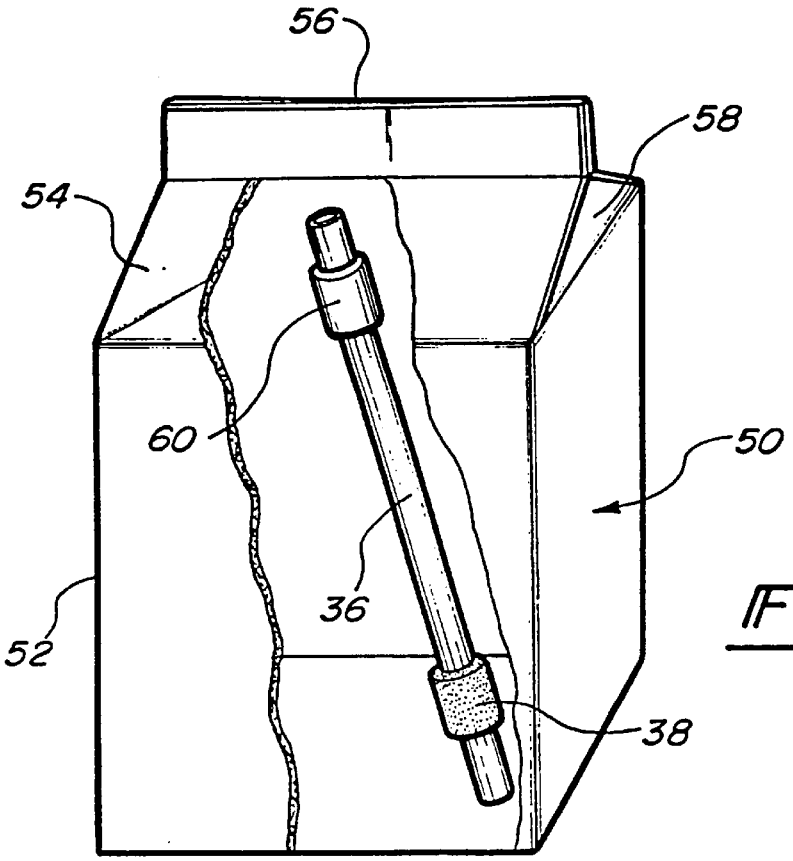
FIG. 9 is a fourth embodiment of the present invention illustrating its application to a gable-top beverage container.

Referring to FIG. 9, an exemplary application of the teachings of the present invention to a gable-top container 50 is shown. The container 50 illustrated in FIG. 9 is of conventional design commonly used as a milk carton. The container 50 is typically formed with a square-sided body 52 having a gabled top portion 54 that is sealed along its upper edge 56. The container 50 is opened by breaking the seal at one end, folding back the top sides, and then forming a spout from the exposed end portion 58 of the gabled top 54 in a conventional manner.

The straw 36 in this embodiment has a float 38 attached near its lower end and a weighted sleeve member 60 attached near its upper end. In the preferred embodiment the upward buoyant force exerted on the straw 36 by the float 38 when liquid is present in the container 50 is slightly greater than the downward gravitational force exerted on the weighted sleeve 60. Accordingly, when the upper end of the straw 36 is aligned with the opening in the container 50, the float 38 will serve to elevate the straw up through the opening.

Once the container 50 has been opened in the conventional manner, the upper end of the straw 36 is aligned with the opening by tilting the container slightly toward the formed spout, being careful, of course, not to inadvertently dispense liquid from the container. The gravitational force on the weighted sleeve 60 causes the upper end of the straw 36 to pivot toward the opening, thus permitting the straw to elevate up through the opening. Optionally, the user may tilt the container 50 toward the appropriate gabled end portion 58 of the container prior to opening of the container to pre-position the upper end of the straw 36 in the vicinity of the opening. In this manner, when the container 50 is then opened, the straw 36 will either immediately, or following further minor manipulation of the container, ascend through the opening.

To temporarily secure the straw 36 to prevent premature elevation and interference with the filling and/or sealing process, any of the techniques previously enumerated in connection with the description of the previous embodiments may be used.

Figure 10:
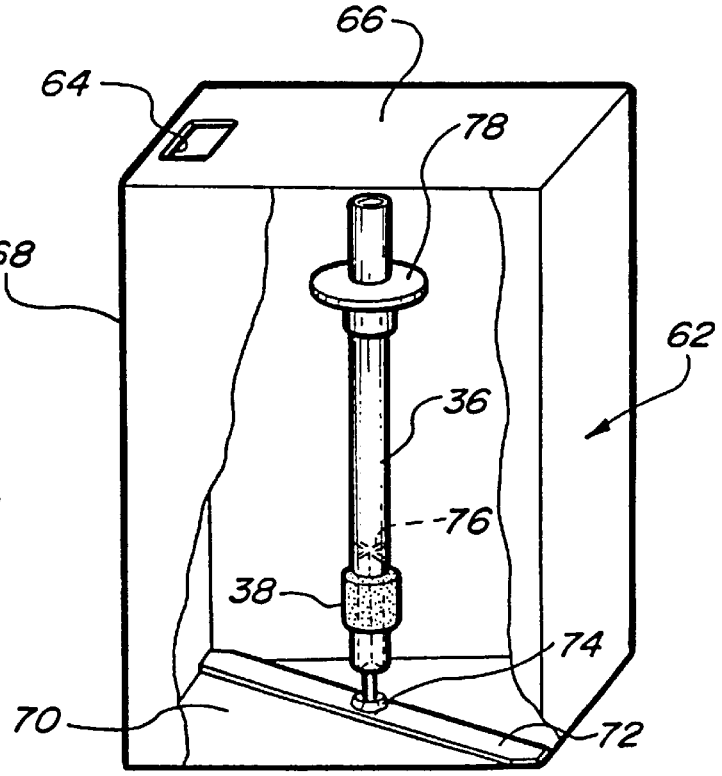
FIG. 10 is a fifth embodiment of the present invention illustrating its application to a rectangular or "aseptic" beverage container.

Turning now to FIG. 10, an exemplary application of the present invention to a rectangular beverage carton or "aseptic" carton 62 is shown. Beverage cartons of this general type typically include an offset orifice 64 that is exposed by the removal of a seal (not shown). Although the orifice 64 is located in the top 66 of the carton 62 shown in FIG. 10, it will be understood that the carton may be formed with the orifice located in a sidewall 68 adjacent the top end 66 of the carton 62.

The straw 36 in this embodiment is supported by a base member or strip 72 that is fitted to, adhered, or otherwise secured to the bottom 70 of the carton 62. A socket 74, similar to that described in the embodiment illustrated in FIGS. 3–5, is located at the center of the base member 72 and is adapted to receive an appropriately sized ball (not shown) that is formed at the bottom of a straw support post 76. The ball end of the straw support post 76 is thus adapted to snap into the socket 74 so that the support post 76 can freely pivot and rotate about the base socket 74.

The straw 36, which is adapted to be slid onto the straw support post 76, has a float 38 attached near its bottom end and a weighted positioning disk 78 attached near its top end. As in the embodiment described in FIGS. 3–5, the positioning disk 78 is sufficiently weighted such that when the carton 62 is tilted, the upper end of the straw 36 pivots accordingly.

Thus, to align the straw 36 with the orifice 64, the carton 62 is tilted slightly toward the orifice. The gravitational force exerted on the positioning disk 78 causes the straw 36 to pivot about the socket 74 in the base member 72 until the positioning disk 78 contacts the sidewall 68 of the carton. The diameter of the positioning disk 78 is sized so that when the disk 78 contacts the sidewall 68 of the carton 62, the upper end of the straw 36 is offset therefrom by an amount sufficient to position the straw beneath the orifice 64. When the straw 36 is aligned with the orifice 64, the buoyancy of the float 38, which is sufficient to overcome the weight of the positioning disk 78, causes the top of the straw 36 to ascend through the orifice until the positioning disk 78 contacts the underside of the top 66 of the carton 62. As before, the user may at this point elect to commence drinking through the straw, or withdraw the straw further from the carton. Preferably, the positioning disk 78 is positioned near the upper end of the straw 36 so that approximately one to two inches of the straw initially projects through the orifice 64, when the positioning disk 78 contacts the underside of the top 66 of the carton 62.

Figure 11:
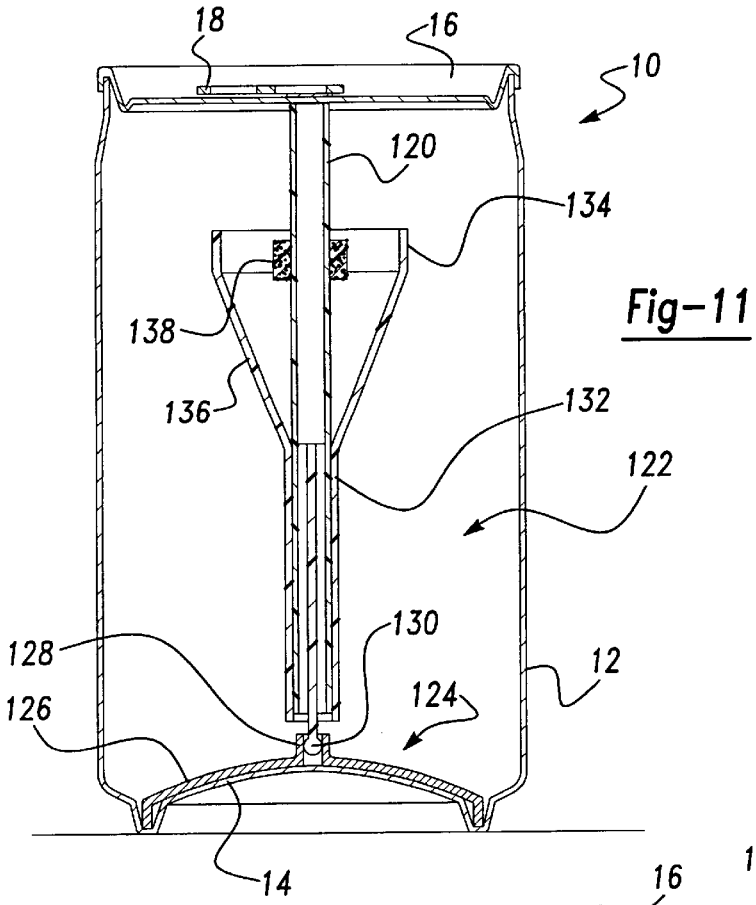
FIG. 11 is a vertical sectional view of a beverage can containing a straw-dispensing mechanism according to a sixth embodiment of the present invention.
Figure 12:
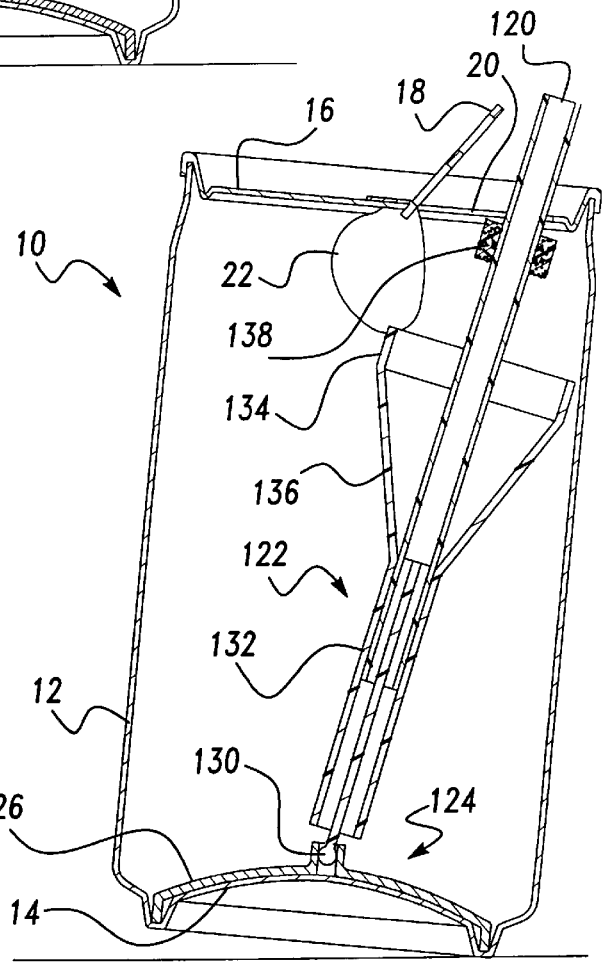
FIG. 12 is an equivalent sectional view of the beverage can shown in FIG. 11 illustrating the position of the straw when the can is slightly tilted.
Figure 13:
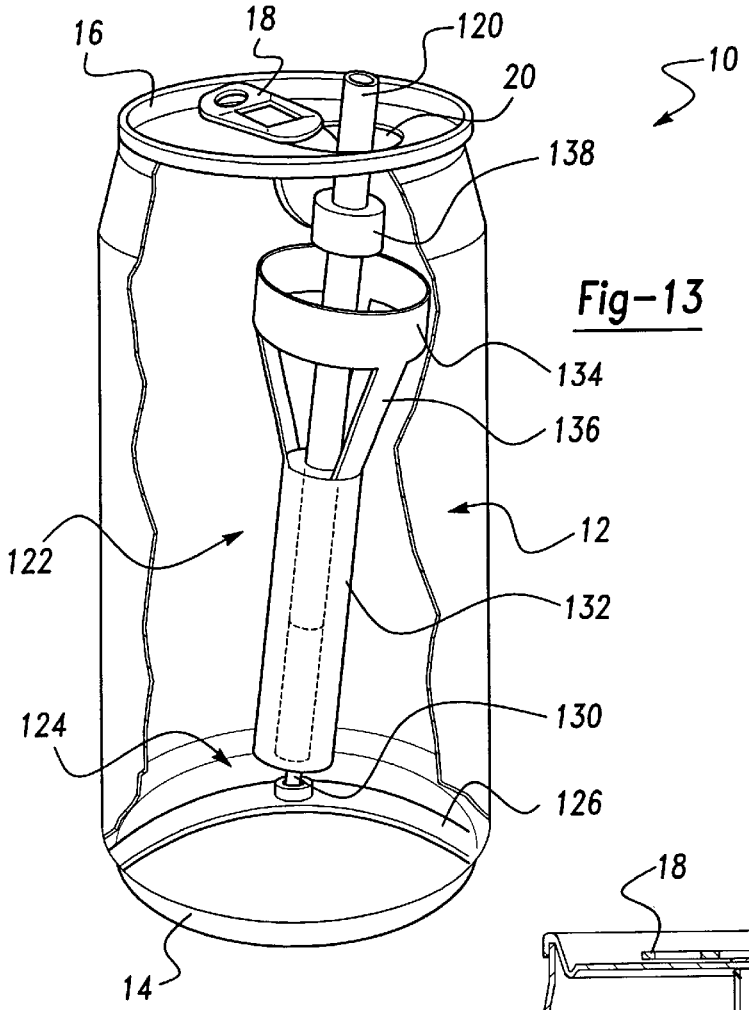
FIG. 13 is a partial cutaway view of the beverage can shown in FIGS. 11 and 12 illustrating the straw ascending through the orifice in the lid of the can.

Referring now to FIGS. 11–13, an alternate embodiment of the present invention is shown. The embodiment shown in FIGS. 11–13 is shown disposed within beverage can 10. The straw dispensing mechanism according to this embodiment of the present invention includes a drinking straw 120, a straw support member 122 and a base member 124. Base member 124 includes either two or three radially extending legs 126. Base member 124 is preferably made from a lightweight plastic material with legs 126 being flexible and adapted to be compression fit to bottom 14 and/or the sidewalls of can body 12. Alternately, base member 124 may be adhered to bottom 14 of beverage can 10 by other means known in the art. Projecting upwardly from the central portion of base 124 is a socket 128 that is adapted to receive a ball as will be described later herein.

Straw support member 122 includes a ball end 130, a tubular portion 132 and a weighted collar 134. Ball end 130 is attached to tubular portion 132 such that liquid within beverage can 10 is free to flow into the lower end of tubular portion 132. Ball end 130 is adapted to be snapped into socket 128 in base 124 so that support member 122 can freely pivot and rotate with respect to socket 128. Tubular portion 132 extends upwardly from ball end 130 and is attached at its upper end to weighted collar 134 through a plurality of fingers 136. Fingers 136 extend from the smaller diameter tubular portion 132 to the larger diameter weighted collar 134. Drinking straw 120 is slidingly received within tubular portion 132 of straw support member 122.

Attached to the upper portion of straw 120 is a buoyant member 138, preferably cellular foam. Buoyant member 138 is designed to provide sufficient buoyant force (when liquid is present in beverage can 10) to cause straw 120 to ascend through orifice 20 in can lid 16 when straw 120 is aligned with orifice 20. It will be noted that straw 120 is of sufficient length to ensure that straw 120 ascends in a straight path up through orifice 20 and that a sufficient length of straw 120 is engaged with tubular portion 132 once straw 120 fully extends through orifice 20. While buoyant member 138 is being illustrated as being attached to straw 120, it is within the scope of the present invention to manufacture straw 120 from a buoyant material thus integrating buoyant member 138 with straw 120.

Weighted collar 134 is designed with sufficient weight that it will cause the upper end of straw support member 122 to fall toward the sidewall of can body 12 when beverage can 10 is tilted as shown in FIG. 12. The diameter of weighted collar 134 is sized so that when weighted collar 134 contacts the sidewall of can body 12, tubular portion 132 and thus straw 120 are offset therefrom by an amount equal to the radial offset of orifice 20 in lid 16. This ensures proper radial alignment between straw 120 and orifice 20 when straw 120 and orifice 20 are circumferentially aligned.

Thus, to align straw 120 with orifice 20 in lid 16, the user follows either of the procedures outlined above. In this embodiment, when beverage can 10 is tilted, the gravitational force exerted on weighted collar 134 causes straw support member 122 together with straw 120 to rotate freely along the sidewall of can body 12 due to the engagement of ball end 130 with socket 128 until the low point is reached (i.e. the direction of the tilt). When straw 120 is aligned with orifice 20, the buoyancy of buoyant member 138 causes the top of straw 120 to ascend through orifice 20 until buoyant member 138 contacts the underside of lid 16. In the preferred embodiment, straw 120 will initially ascend 1–2 inches above lid 16. The incorporation of weighted collar 134 into straw support 122 rather than having a weighted member attached to straw 120 requires buoyant member 138 only to lift straw 120 and not weighted collar 134 thus reducing the size requirements for buoyant member 138.

At this point, the user may elect to commence drinking through straw 120 or withdraw straw 120 further from beverage can 10. In this embodiment, buoyant member 138 may be formed with sufficient flexibility to enable the user to extract buoyant member 138 through orifice 20 as straw 120 is pulled out of beverage can 10. Straw 120, similar to the previous embodiments, is preferably convoluted along most of its length so that it can thereafter be extended by the user to reach fully to the bottom of beverage can 10.

To prevent the buoyant member 138 from elevating the straw 120 during the can filling and seaming processes, and thus possibly interfering with these processes, a small amount of soluble adhesive, such as glucose or thixotropic gel, is preferably applied to temporarily bond straw 120 to support member 122. Accordingly, after the seaming operation is completed, the adhesive will gradually dissolve and thereby enable straw 120 to float freely upward until it contacts the underside of lid 16.

Figure 14:
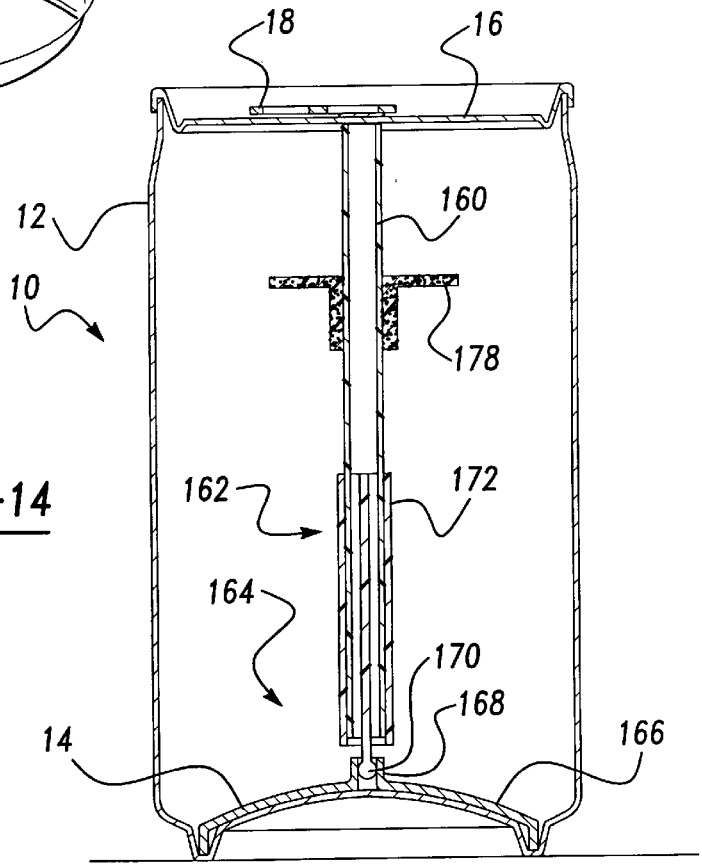
FIG. 14 is a vertical sectional view of a beverage can containing a straw-dispensing mechanism according to a seventh embodiment of the present invention.
Figure 15:
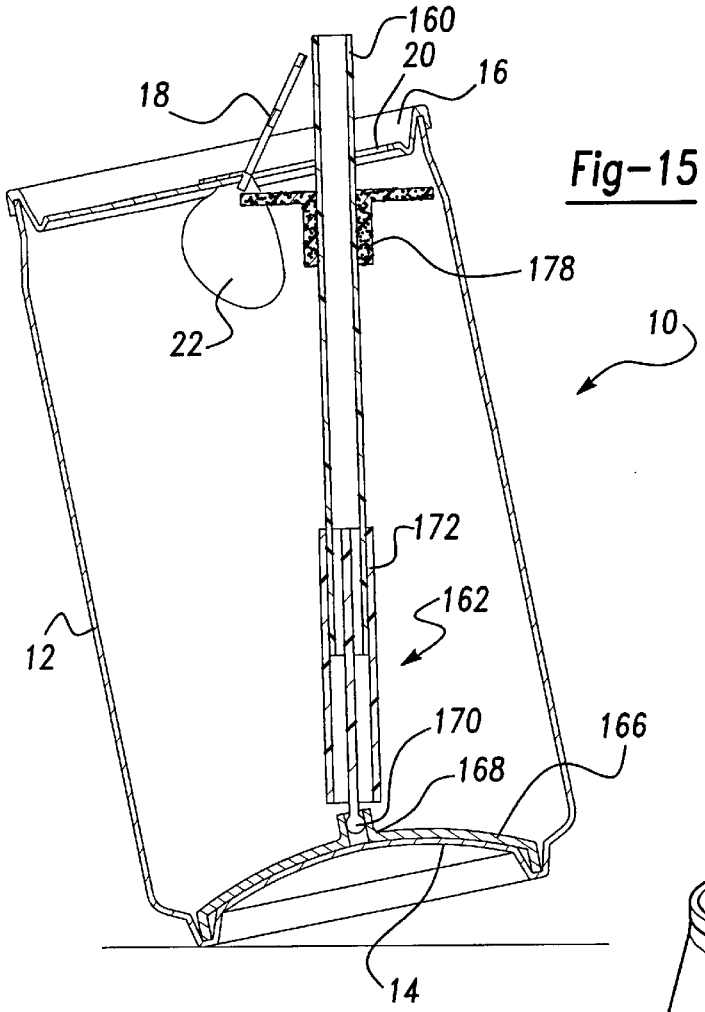
FIG. 15 is an equivalent sectional view of the beverage can shown in FIG. 14 illustrating the position of the straw when the can is slightly tilted.
Figure 16:
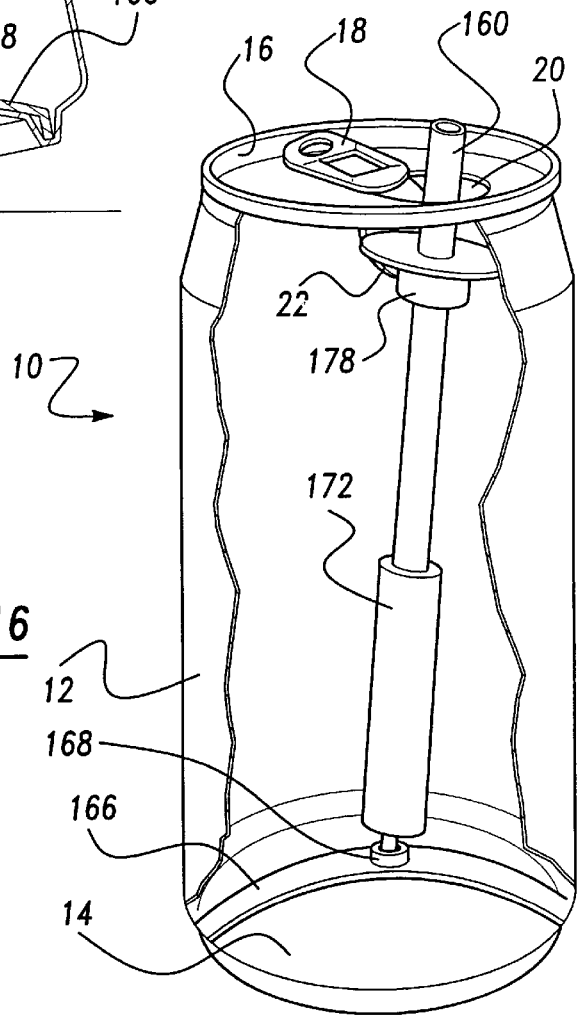
FIG. 16 is a partial cutaway view of the beverage can shown in FIGS. 14 and 15 illustrating the straw ascending through the orifice in the lid of the can.

Referring now to FIGS. 14–16, an alternate embodiment of the present invention is shown. The embodiment shown in FIGS. 14–16 is shown disposed within beverage can 10. The straw dispensing mechanism according to this embodiment of the present invention includes a drinking straw 160, a straw support member 162 and a base member 164. Base member 164 includes either two or three radially extending legs 166. Base member 164 is preferably made from a lightweight plastic material with legs 166 being flexible and adapted to be compression fit to bottom 14 and/or the side walls of can body 12. Alternately, base member 164 can be a suction cup, may be precision fit tot he inside of can body 12 or may be adhered to bottom 14 of beverage can 10 by other means known in the art. Projecting upwardly from the central portion of base 164 is a socket 168 that is adapted to receive a ball as will be described later herein.

Straw support member 162 includes a ball end 170 and a tubular portion 172. Ball end 170 is attached to tubular portion 172 such that liquid within beverage can 10 is free to flow into the lower end of tubular portion 172. Ball end 170 is adapted to be snapped into socket 168 in base 164 so that support member 162 can freely pivot and rotate with respect to socket 168. Tubular portion 172 extends upwardly from ball end 170. Drinking straw 160 is slidingly received within tubular portion 172 of straw support member 162. While drinking straw 160 is illustrated for exemplary purposes as being slidingly received within tubular portion 172, it is within the scope of the present invention to replace tubular portion 172 with straw support post 34' shown in FIGS. 3–5 and then have drinking straw 160 slide onto support post 34' similar to straw 36 if desired.

Attached to the upper portion of straw 160 is buoyant member 178 having a central aperture or bore formed therein for frictionally receiving straw 160. Alternatively, straw 160 may be bonded within the central aperture of buoyant member 178 or buoyant member 178 may be integrally formed on straw 160. Buoyant member 178 is preferably cellular foam and is designed to provide sufficient buoyant force (when liquid is present in beverage can 10) to cause straw 160 to ascend through orifice 20 in can lid 16 when straw 160 is aligned with orifice 20. It will be noted that straw 160 is of sufficient length to ensure that straw 160 ascends in a straight path up through orifice 20 and that a sufficient length of straw 160 is engaged with tubular portion 172 once straw 160 fully extends through orifice 20. The diameter of buoyant member 178 is sized so that when buoyant member 178 contacts the sidewall of can body 12, straw 160 is offset therefrom by an amount equal to the radial offset of orifice 20 in lid 16. This ensures proper radial alignment between straw 160 and orifice 20 when straw 160 and orifice 20 are circumferentially aligned. In order to reduce the overall size of buoyant member 178, straw 160 may also be manufactured from a buoyant material.

To align the straw 160 with orifice 20 in lid 16, the user momentarily tilts the can toward himself with the closure tab 22 aligned in approximately the 2 o'clock position, or angularly offset slightly from opposite to the user (the 6 o'clock position defining the direction toward the user, the 12 o'clock position defining opposite to the user). The tilting of the can toward the user causes buoyant member 178 and thus straw 160 to remain vertical due to the buoyant force on buoyant member 178. This positions buoyant member 178 and straw 160 at the 12 o'clock position so that straw 160 is slightly misaligned with closure tab 22 and orifice 20. With beverage can 10 preferably reoriented to its normal vertical position, the user then lifts lever ring 18 to deflect closure tab 22 into the interior of beverage can 10. With orifice 20 now opened, a further slight manipulation or tilting of beverage can 10 away from the direction of orifice 20 serves to bring straw 160 into alignment and thereby permit straw 160 to ascend through orifice 20.

Note, when the can is initially tilted toward the user, it is preferred that closure tab 22 be oriented in the 2 o'clock position rather than the 10 o'clock position. This is due to the fact that conventional beverage cans typically have closure tabs 22 that are designed to deflect downwardly and toward the left side of orifice 20 (i.e., left-hinged closure tabs). Consequently, when beverage can 10 is subsequently opened by the lifting of lever ring 18, closure tab 22 does not strike straw 160 as it is deflected into the interior of beverage can 10, nor does it obstruct the final movement of straw 160 to bring it into alignment with orifice 20. Obviously, for beverage cans with right-hinged closure tabs, an initial 10 o'clock position would be preferred.

Optionally, of course, the user may elect to open beverage can 10 first before beverage can 10 is manipulated to bring straw 160 into alignment with orifice 20. When this procedure is followed, the user tilts the opened beverage can 10 away from the direction of orifice 20. The resulting movement of buoyant member 178 will thus bring straw 160 directly into alignment with orifice 20. The use of buoyant member 178 to align straw 160 rather than a weight reverses the direction of tilt for beverage can 10 thus reducing the tendency to inadvertently dispense or spill liquid from the can.

In addition, the user may manipulate beverage can 10 in other ways to cause straw 160 to move into alignment with orifice 20. For example, the user may impart a circular motion to the can to initiate a circular movement of the liquid within beverage can 10. Attentively, the user may combine both circular and tilting motions and impart a slow "wobble" to beverage can 10 to facilitate the desired rotational movement of straw 160.

At this point the user may elect to commence drinking through the straw, or withdraw the straw further from the can. In this embodiment, buoyant member 178 may be formed with sufficient rigidity and the frictional interface between straw 160 and buoyant member 178 may be sufficiently low to permit straw 160 to be pulled upwardly through buoyant member 178 as buoyant member 178 is held against the underside of lid 16. As presently noted, straw 160 is preferably convoluted along most of its length so that it can thereafter be extended by the user to reach fully to the bottom of beverage can 10.

Alternatively, buoyant member 178 may be sized and designed with sufficient flexibility to enable the user to extract buoyant member 178 through orifice 20 as straw 160 is pulled out of beverage can 10. Once pulled through orifice 20 and while still positioned on straw 160, buoyant member 178 may optionally be configured to compressively fit into orifice 20. The user may thereupon elect to position buoyant member 178 into orifice 20 so that it is retained under slight compression along the edges of orifice 20. Once positioned in this manner, buoyant member 178 serves to stabilize straw 160 during use and also substantially encloses orifice 20 to prevent contaminants as well as insects from entering the can.

To prevent buoyant member 178 from elevating straw 160 during the can filling and seaming processes, and thus possibly interfering with these processes, a small amount of soluble adhesive, such as glucose or thixotropic gel, is preferably applied to temporarily bond straw 160 to support member 162. Accordingly, after the seaming operation is completed, the adhesive will gradually dissolve and thereby enable straw 160 to float freely upward until it contacts the underside of lid 16.

Figure 17:
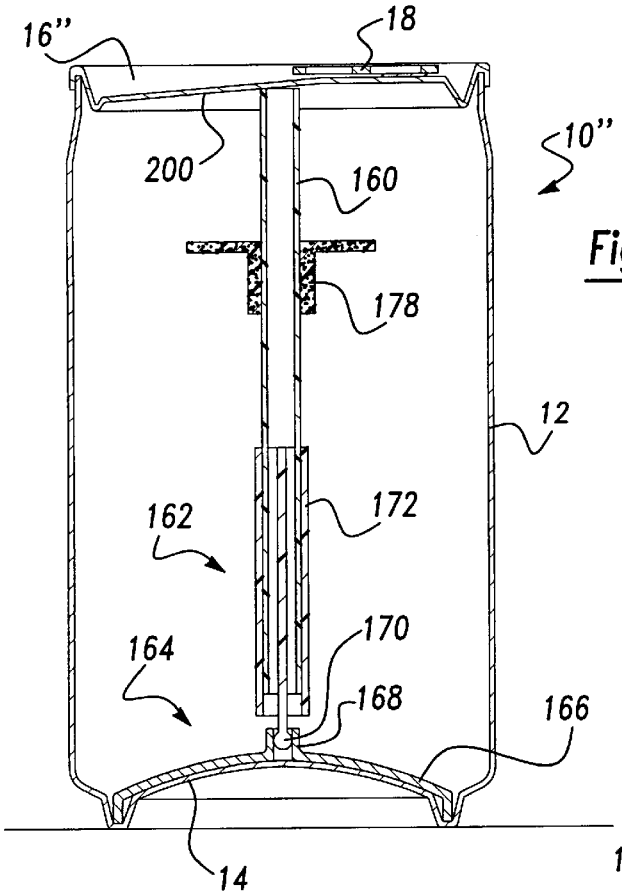
FIG. 17 is a vertical sectional view of a beverage can containing a straw-dispensing mechanism according to an eighth embodiment of the present invention.
Figure 18:
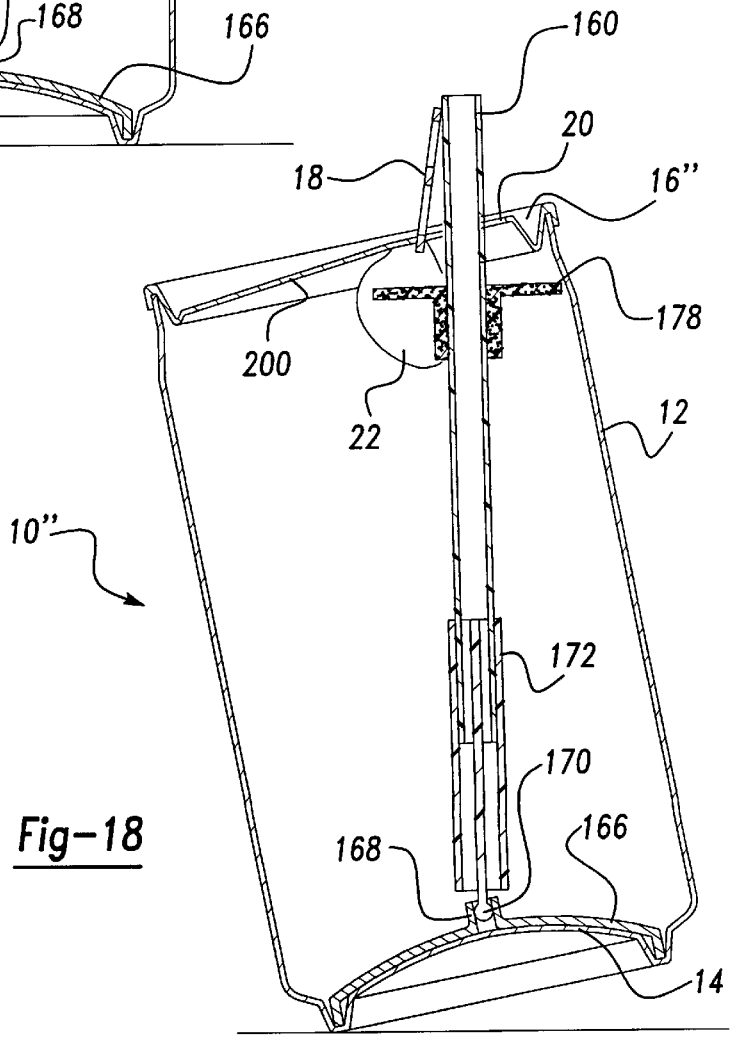
FIG. 18 is an equivalent sectional view of the beverage can shown in FIG. 17 illustrating the position of the straw when the can is slightly tilted.
Figure 19:
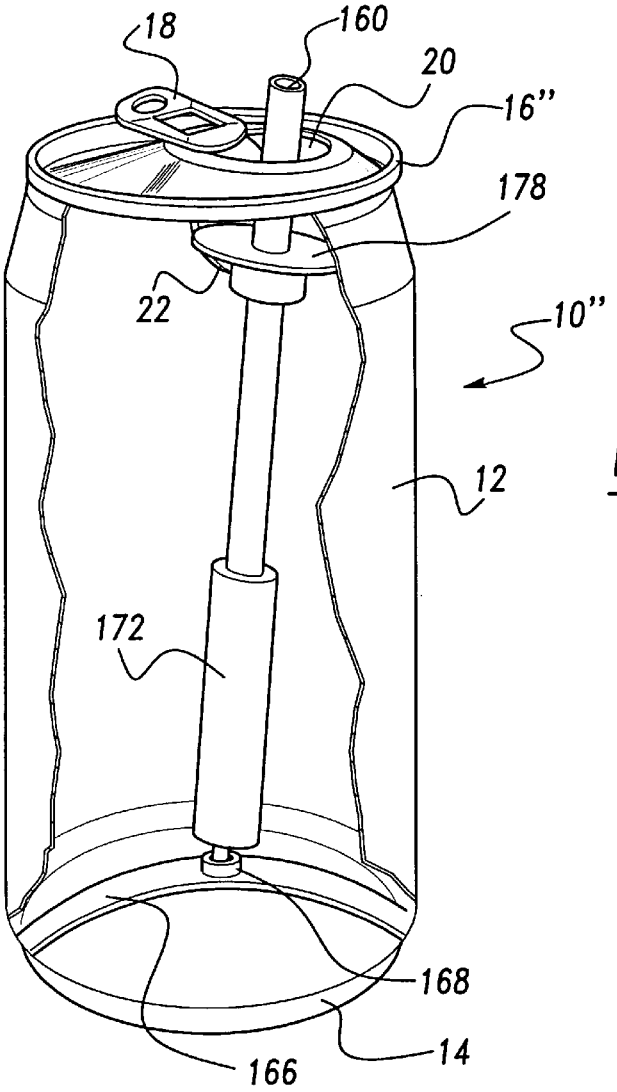
FIG. 19 is a partial cutaway view of the beverage can shown in FIGS. 17 and 18 illustrating the straw ascending through the orifice in the lid of the can.

Referring now to FIGS. 17–19, an alternate embodiment of the present invention is shown. The embodiment shown in FIGS. 17–19 are similar to the embodiment shown in FIGS. 14–16 except that beverage can 10 is replaced with beverage can 10". Beverage can 10" comprises an aluminum, steel or plastic container having cylindrical body 12 with closed bottom 14 and a lid 16" that is joined by a seaming operation to body 12. Lid 16" includes actuating member lever ring 18 pivotally secured to lid 16" that is adapted when actuated to open orifice 20 in lid 16" by deflecting closure tab 22 into the interior of beverage can 10". Closure tab 22 is formed by score lines in lid 16" which enable a controlled portion of closure tab 22 to break free of lid 16" when lever ring 18 is actuated against tab 22 by the user. As the user lifts ring 18 to its maximum extent, closure tab 22 is typically designed via the score lines to deflect downwardly and toward one side of orifice 20 to fully open orifice 20 and facilitate the free flow of liquid through orifice 20. While lid 16 is formed having a generally flat horizontal wall for closing beverage can 10, lid 16" is formed to define a contoured interior surface 200 which angles or funnels towards orifice 20. Alternatively, contoured interior surface 200 can be a domed surface as shown in FIG. 19.

The straw dispensing mechanism according to this embodiment of the invention is identical to and functions the same as the straw dispensing mechanism described above for FIGS. 14–16. Thus, to align straw 160 with orifice 20 in lid 16", the user follows either one of the two procedures defined above for FIGS. 14–16. This embodiment of the invention provides the advantage that when buoyant member 178 is urging straw 160 upward against lid 16' due to the buoyancy of buoyant member 178, interior surface 200 will act to guide or funnel straw 160 toward orifice 20.

It will further be understood that the invention is subject to additional variation and modification without departing from the spirit of the invention as set forth in the appended claims.

What is claimed is:

1. A beverage container having a body with a closed bottom end and a top end having associated therewith a normally closed orifice, said beverage container further comprising:

a support member disposed within said container and pivotably disposed within said body;

a straw slidingly engaging said support member; and a weighted member operatively associated with said straw and gravity responsive to manipulation of said container to cause said support member to move within said container and thereby align said straw with said orifice through appropriate manipulation of said container.

2. The beverage container of claim 1 wherein, said weighted member is adapted to move said support member in the direction in which said container is tilted.

3. The beverage container of claim 1 wherein, said support member and said straw are substantially vertically oriented within said container so as to define a top end and a bottom end and further including means for elevating said top end of said straw through said orifice when aligned with said orifice.

4. The beverage container of claim 3 wherein, said elevating means is a buoyant member attached to said straw.

5. The beverage container of claim 3 further including means for temporarily retaining said straw to said support member so that said straw does not protrude from said body when said container is initially filled.

6. The beverage container of claim 3 further including a base member positioned within said container, said support member being pivotably coupled to said base member for supporting said straw in said substantially vertical orientation within said container.

7. The beverage container of claim 6 further including means for temporarily securing said straw to said support post.

8. The beverage container of claim 6 wherein, said beverage container comprises a cylindrical body and a circular lid enclosing said top end of the container, said lid having a tab for enclosing said orifice in said lid and an actuating member for deflecting said tab into the interior of said container to open said orifice, and further wherein said support member is pivotably connected at one end to a central portion of said base member and joined at its other end to a vertically oriented post with which said straw is slidably engaged.

9. The beverage container of claim 8 wherein, said weighted member is integrally a part of said support member.

10. The beverage container of claim 3 wherein, said weighted member comprises a positioning disk that is attached to said straw near a top end of said straw.

11. The beverage container of claim 10 wherein, said weighted member has a side edge that is adapted to contact an inside wall of said body of said container.

12. The beverage container of claim 11 wherein, said orifice is spaced from a sidewall of said container and wherein said side edge of said weighted member is spaced from said straw by an amount sufficient to align said top end of said straw with said orifice when said straw is positioned beneath said orifice.

13. The beverage container of claim 12 further including a base member positioned within said container, said support member being pivotably mounted at one end to a central portion of said base member and is adapted to receive said straw at its other end so that said straw is slidably mounted with respect to said support member.

14. The beverage container of claim 1 wherein, said top end includes a contoured surface for guiding said straw to said orifice.

15. A beverage container having a body with a closed bottom end and a top end having a normally closed orifice associated therewith, said beverage container further comprising:

a straw disposed within said body of said container in a substantially vertical orientation so as to define a top end and a bottom end;

a base member positioned within said container;

straw supporting means pivotably coupled to said base member for supporting said straw in said substantially vertical orientation; and means for causing said straw supporting means to pivot about said base member in response to tilting of said container to move said straw into alignment with said orifice.

16. The beverage container of claim 15 wherein, said means for causing said straw supporting means to rotate comprises a weighted member attached near said top end of said straw and having a side edge adapted to contact an inside wall of said container and an aperture for attachment to said straw, said aperture being spaced from said side edge by an amount sufficient to align the top end of said straw with said orifice when said straw is positioned beneath said orifice.

17. The beverage container of claim 15 wherein, said top end defines a contoured surface for guiding said straw to said orifice.

18. A beverage container having a body with a closed bottom, said beverage container further having a top end secured to said body, said top end having a normally closed asymmetrically located orifice associated therewith, said beverage container further comprising:

a straw disposed within said body of said container in a substantially vertical orientation so as to define a top end and a bottom end, said top end of said straw being positioned within said container randomly with respect to said orifice; and a positioning member attached near the top end of said straw and responsive to a manipulation of the body of the container to move the top end of said straw from an unaligned position into alignment with said orifice.

19. The beverage container of claim 18 wherein, said positioning member includes a side edge adapted to contact an inside wall of the container and an aperture for attachment to said straw, said aperture being spaced from said side edge by an amount sufficient to align said top end of said straw with said orifice when said straw is positioned beneath said orifice.

20. The beverage container of claim 18 further including means for temporarily retaining said straw within said body of said container.

21. The beverage container of claim 18 wherein, said top end defines a contoured surface angled towards said orifice.

* * * * *